US006364698B1

(12) United States Patent
Tsai

(10) Patent No.: US 6,364,698 B1
(45) Date of Patent: Apr. 2, 2002

(54) STRUCTURE OF A FRAME FOR MULTI-PORT CONNECTOR

(75) Inventor: Nelson Tsai, Hsi-Chih (TW)

(73) Assignee: Wieson Electronic Co., Ltd., Taipei (TW)

( * ) Notice: Subject to any disclaimer, the term of this patent is extended or adjusted under 35 U.S.C. 154(b) by 0 days.

(21) Appl. No.: 09/822,185

(22) Filed: Apr. 2, 2001

(51) Int. Cl.[7] ..... H01R 13/60; H01R 13/66
(52) U.S. Cl. ..... 439/541.5; 439/607
(58) Field of Search ..... 439/607, 540.1, 439/541.5

(56) References Cited

U.S. PATENT DOCUMENTS 4,878,856 A * 11/1989 Maxwell ..... 439/540
5,037,330 A * 8/1991 Fulponi et al. ..... 439/607
5,085,590 A * 2/1992 Galloway ..... 439/95
5,336,109 A * 8/1994 Hillbish et al. ..... 439/540
5,755,592 A * 5/1998 Hillbish et al. ..... 439/541.5
6,077,114 A * 6/2000 Lu ..... 439/541.5
6,126,481 A * 10/2000 Wu et al. ..... 439/541.5
6,149,459 A * 11/2000 Yang ..... 439/541.5
6,200,161 B1 * 3/2001 McClinton et al. ..... 439/541.5
6,227,904 B1 * 5/2001 Wang et al. ..... 439/541.5
6,234,834 B1 * 5/2001 Tsai et al. ..... 439/541.5
6,244,895 B1 * 6/2001 Huang ..... 439/541.5

* cited by examiner

*Primary Examiner*—Brian Sircus
*Assistant Examiner*—Hae Moon Hyeon
(74) *Attorney, Agent, or Firm*—Rosenberg, Klein & Lee

(57) ABSTRACT

The present invention relates to a structure of a frame for multi-port connectors having frame body covered the connector externally and a plurality of extension sections, wherein the frame body comprises a first frame body and a second frame body being formed as one unit, and the flat surface of the first frame body is slightly hither than the flat surface of the second frame body, the flat surface of the first frame body is provided with one or more than one connection-port insertion slots, the front end of the first frame body is connected integrally with a plurality of protruded/extended sections forming into a common ground terminal for the connector frame; the second frame body has a flat surface being provided with at least one connection-port insertion slot, and position screw holes are respectively provided on the two sides of the connection-port insertion slot, and the first frame body and a second frame body are combined to form a multi-port connector frame for mounting onto a multi-port connector.

2 Claims, 3 Drawing Sheets

STRUCTURE OF A FRAME FOR MULTI-PORT CONNECTOR

BACKGROUND OF THE INVENTION (a) Field of the Invention

The present invention relates to a structure of a frame for multi-port connector, and in particular, a connector frame having a plurality of different shapes of insertion slots on the frame body thereof, and a connector frame which facilitates manufacturing process and reduces the cost of production.

(b) Description of the Prior Art

In order to connect various types of input/output peripherals of computers or the like, the mother board of host computer must be provided with connection-port insertion slots for various interface, for instance, USB connection-port, PS/2 connection-port, LPT communication connection-port, RS 232 communication connection-port, etc. In recent years, as a result of rapid development of computer and the peripherals thereof, and at the same time, minimizing utilization space, all connect-port insertion slots are positioned at one area so as to simplify the structural mechanism and to reduce the size thereof, and minimize the numbers of soldering steps in the process of installation. And this can achieve the reduction of production cost. However, in manufacturing, in order to avoid disturbance as a result of crosstalk, the metal hood body covers the external of the connector such that the hood shares the common ground terminal. But, the structure and the configuration of such connector with the common ground terminal are rather complicated and cannot be made with one molding process, therefore the cost of manufacturing increases.

SUMMARY OF THE INVENTION

Accordingly, it is an object of the present invention to provide a structure of a frame for multi-port connector, which can mitigate the above drawbacks and improve the sharing of the plurality of the connector insertion slots so as to minimize space that required.

Yet another object of the present invention to provide a structure of a frame for multi-port connector, wherein a plurality of different shapes of insertion slots are commonly provided on a single connector frame so as to reduce the size of the connector and to simplify the mounting process and reduce the cost of production.

A further object of the present invention to provide a structure of a frame for multi-port connector, wherein the frame body comprises a first frame body and a second frame body being formed as one unit, and the flat surface of the first frame body is located slightly higher than the flat surface of the second frame body, the flat surface of the first frame body is provided with one or more than one connection-port insertion slots, the front end of the first frame body is connected integrally with a plurality of protruded/extended sections forming into a common ground terminal for the connector frame; the second frame body has a flat surface being provided with at least one connection-port insertion slot, and positioning screw holes are respectively provided on the two sides of the connection-port insertion slot, and the first frame body and a second frame body are combined together to form a multi-port connector frame for mounting onto another multi-port connector.

Yet a further object of the present invention to provide a structure of a frame for multi-port connector, wherein the frame body has a flat surface being provided with one or more than one connection-ports insertion slot, and the front end of the frame body is integrally connected to a plurality of protruded/extended sections forming into a common ground terminal for the multi-port connector, and the rear end of the frame body is integrally connected to two symmetrical protruded/extended sections, and two protruded/extended sections are respectively provided with screw holes so as to form into a frame for multi-port connector for mounting together with other frame of connectors at one side.

Additional objects and features of the invention will be understood from the following description and claims and the accompanying drawings.

DETAILED DESCRIPTION OF THE PRESENT INVENTION

Figure 1:
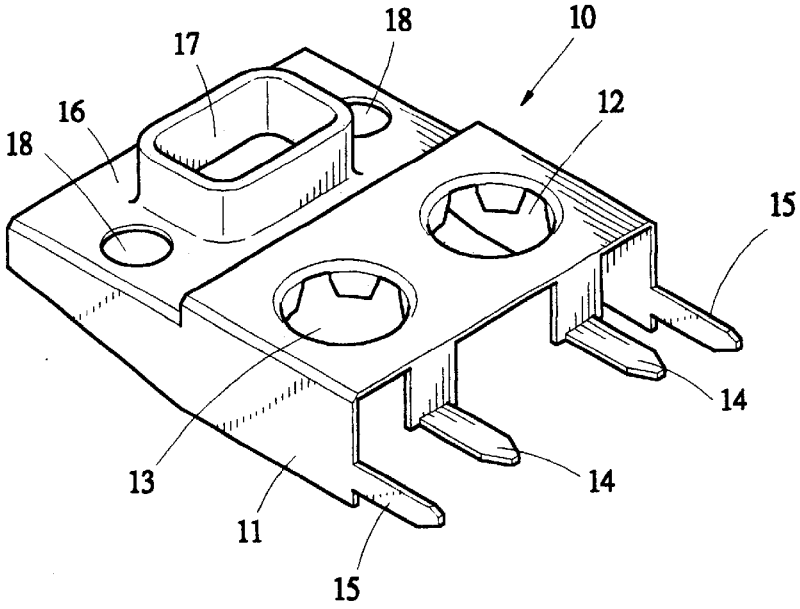
FIG. 1 is a perspective view of a structure of a frame for multi-port connector of the present invention.

Referring to FIG. 1, there is shown a structure of a frame 10 for multi-port connector comprising frame body externally covered the connector and a plurality of extension sections 14, 15 integrally joined to the frame body.

Figure 2:
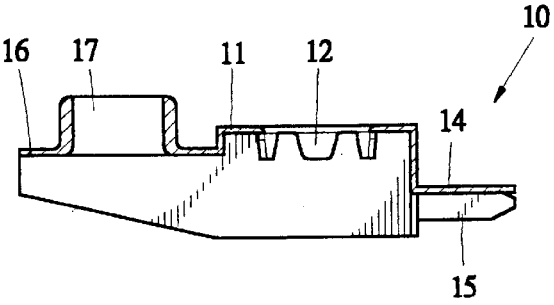
FIG. 2 is a sectional view of a structure of a frame for multi-port connector of the present invention as shown in FIG. 1.
Figure 3:
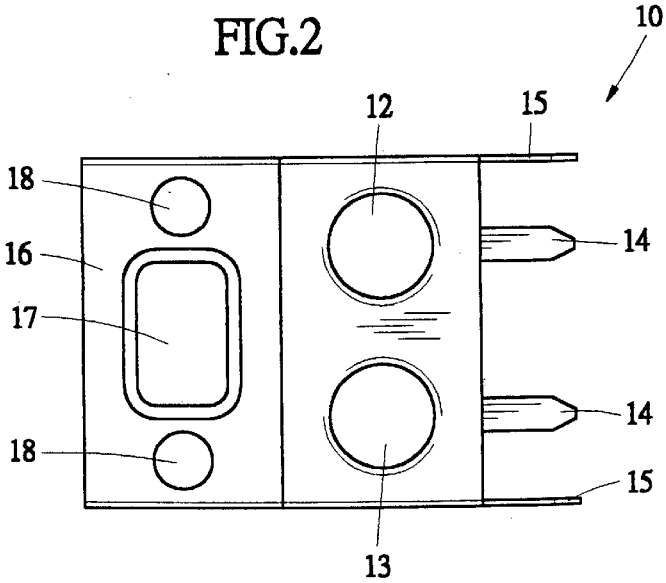
FIG. 3 is a top view of a structure of a frame for multi-port connector of the present invention as shown in FIG. 1.

As shown in FIGS. 1, 2 and 3, the frame body comprises a first frame body 11 and a second frame body 16 formed integrally as a unit, and the height of the flat surface of the first frame body 11 is slightly higher than that of the second frame body 16, and at least one or more than one connection-port insertion slots 12, 13 is/are formed on the flat surface of the first frame body 11, and the front end of the frame body 11 is integrally connected to a plurality of protruded/extended sections 14, 15 to form a common ground terminal of the multi-port frame 10.

In accordance with the present invention, the second frame 16 is integrally connected to the rear end of the first frame 11 and the flat surface of the second frame body 16 is provided with at least a connection-port insertion slot 17, and at the two lateral sides of the insertion slot 17, screw holes 18 for locking is provided thereto. The first frame body 11 and the second frame body 16 are commonly formed into a multi-port connector frame 10 for locking and installation on a multiple-port connector.

In accordance with the present invention, the two connection-port insertion slots 12, 13 on the flat surface of the first frame body 11 can be either a single connection-port insertion slot, or two similar types of insertion slot. For instance, the PS/2 connection-port insertion slot or a plurality of insertion slots of various kinds, such as PS/2 connection-port insertion slot and the USB connection-port insertion slot. The connection-port insertion slot 17 on the flat surface of the second frame body 16 can be either a single connection-port insertion slot, for instance, a RS232 communication connection-port insertion slot or other connection-port insertion slot.

The multi-port connector frame 10 provides a plurality of connection-port insertion slot with one single frame mechanism. Thus, the frame 10 allows connection ends to share the frame, and the required space for a plurality of connectors is thus minimized.

Figure 4:
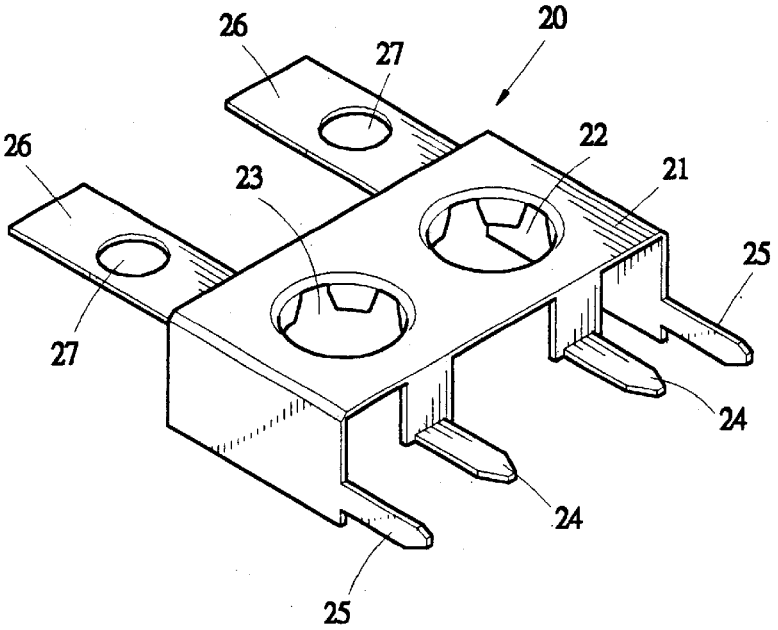
FIG. 4 is a perspective view of a structure of a frame for multi-port connector of another preferred embodiment of the present invention.
Figure 5:
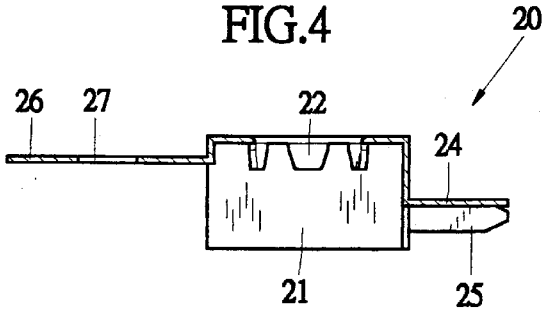
FIG. 5 is a sectional view of a structure of a frame for multi-port connector of the present invention shown in FIG. 4.
Figure 6:
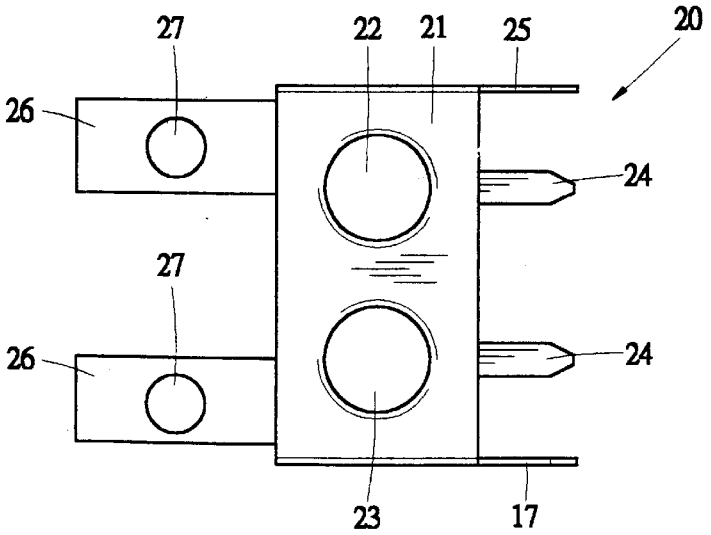
FIG. 6 is a top view of a structure of a frame for multi-port connector of the present invention as shown in FIG. 4.

FIGS. 4, 5 and 6 show another preferred embodiment of the multi-port connector frame of the present invention.

As shown in FIGS. 4, 5 and 6, there is shown a connector 20 similar to that of the first frame body 11 of the frame 10.

As shown in the Figure, the frame body 21 has a flat surface being provided with one or more than one connection-port insertion slots 22, 23, and the front end of the frame body 21 is integrally connected to a plurality of protruded/extended sections 24, 25 forming into a common ground terminal for the multi-port connector, the rear end of the frame body 21 is integrally connected to two symmetrical protruded/extended sections 26, the two symmetrical protruded/extended sections 26 being respectively provided with screw holes 27 so as to form into a frame or multi-port connector for mounting together with other frame of connectors at one side.

Figure 7:
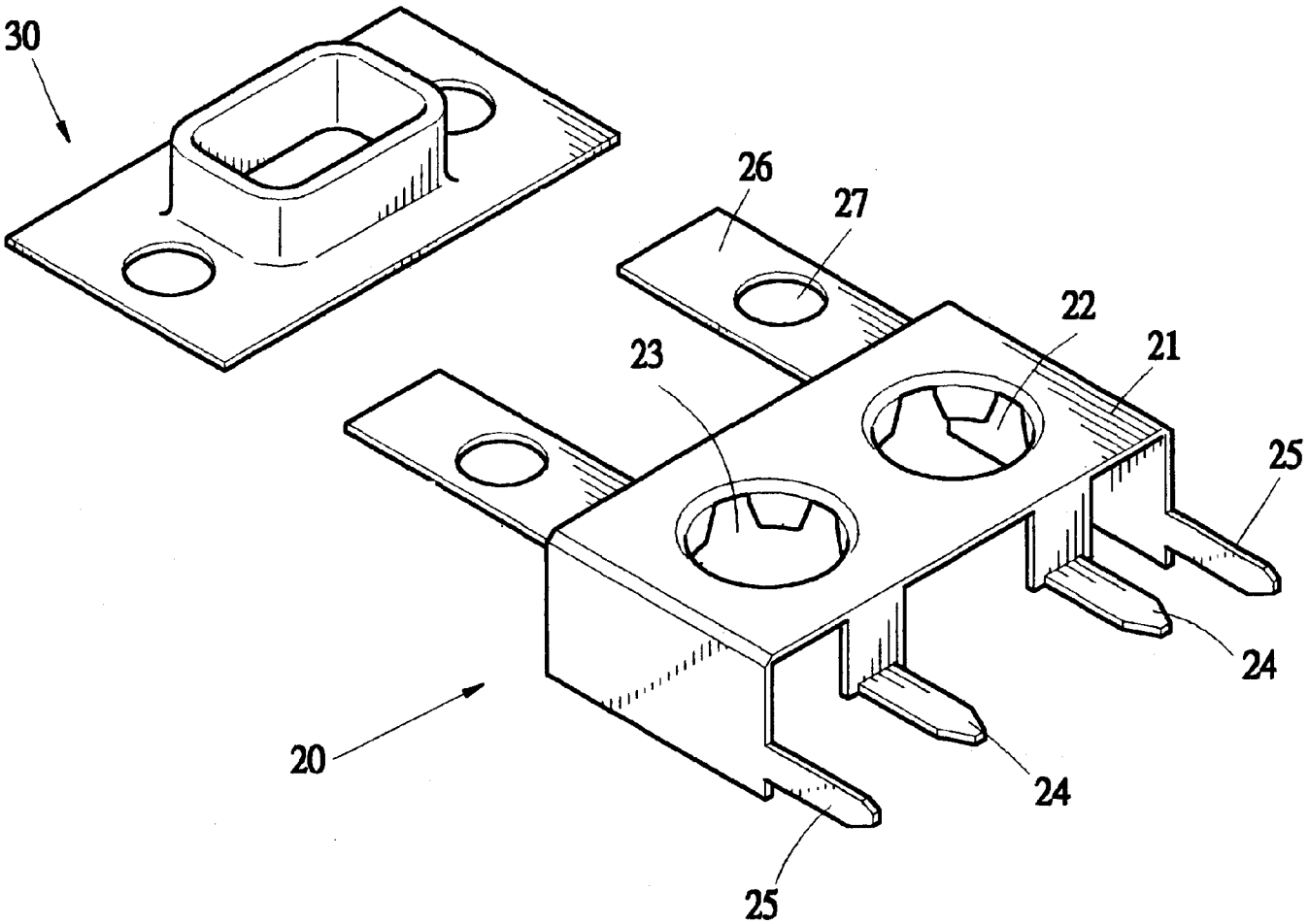
FIG. 7 schematically shows the connection of a structure of a frame for multi-port connector of the present invention with a conventional connector frame.

In application, as shown in FIG. 7, the connector frame 20 of the present invention can be connected to one side of a conventional frame 30 by means of the two protruded/extended sections 26 and the screw holes 27 to form a multi-port connector frame, allowing rapid mounting of the connector.

For the connector frame 30, it can be conventional RS232 communication connection-port insertion slot frame, and can also be other type of connector housing, for instance, double layered connector, allowing the locking of the two protruded/extended sections 26 and the screw holes 27.

While the invention has been described with respect to preferred embodiment, it will be clear to those skilled in the art that modifications and improvements may be made to the invention without departing from the spirit and scope of the invention. Therefore, the invention is not to be limited by the specific illustrative embodiment, but only by the scope of the appended claims.

What is claimed is:

1. A structure of a frame for a multi-port connector comprising:

(a) a frame body for externally covering a connector, said frame body having a flat surface provided with a plurality of insertion slots for a variety of connection-ports; and (b) a plurality of extension sections externally projecting from a first side of said frame body, said extension section forming a common ground terminal for said frame body, said frame body having a first frame member and a second frame member, said first frame member having a planar first upper surface, said second frame member having a planar second upper surface, said planar first upper surface being positioned above said planar second upper surface and having one or more connection-port insertion slots formed therethrough, a front edge of said first frame member being integrally connected with said plurality of extension sections forming said common ground terminal for said connector frame, said planar second upper surface having at least one connection-port insertion slot and a pair of screw holes formed therethrough, said frame being mountable on a variety of connectors to form said multi-port connector.

2. A structure of a frame for a multi-port connector comprising:

(a) a first frame body for externally covering a connector, said first frame body having a flat surface provided with a plurality of insertion slots for a variety of connection-ports;

(b) a plurality of extension sections externally projecting from a first side of said frame body, said extension sections forming a common ground terminal for said frame body, said first frame body having a planar upper surface, said planar upper surface having one or more connection-port insertion slots formed therethrough, a front edge of said first frame body being integrally connected with said plurality of extension sections forming said common ground terminal, a rear edge of said first frame body being integrally connected with a pair of symmetrical extension sections, said pair of symmetrical extension sections each having a screw hole formed therethrough, said first frame body being mountable on a variety of connectors to form said multi-port connector; and (c) a secondary frame body having a pair of screw holes aligned with said screw holed of said symmetrical extension sections, said secondary frame body being mounted to said first frame body.

* * * * *

UNITED STATES PATENT AND TRADEMARK OFFICE

CERTIFICATE OF CORRECTION

PATENT NO. : 6,364,698 B1
DATED : April 2, 2002
INVENTOR(S) : Birbara et al.

It is certified that error appears in the above-identified patent and that said Letters Patent is hereby corrected as shown below:

Title page,
Item [*] Notice, delete the phrase "by 0 days" and insert -- by 44 days --

Signed and Sealed this

Eleventh Day of May, 2004

JON W. DUDAS
*Acting Director of the United States Patent and Trademark Office*